US006227965B1

(12) United States Patent
Howard

(10) Patent No.: US 6,227,965 B1
(45) Date of Patent: May 8, 2001

(54) SINGLE PAGE MULTI-PART FORM OR "QUIKFOLDFORM"

(76) Inventor: Edwin Lee Howard, 2305 Wexford La., Vestavia, AL (US) 35216

( * ) Notice: Subject to any disclaimer, the term of this patent is extended or adjusted under 35 U.S.C. 154(b) by 0 days.

(21) Appl. No.: 09/361,416

(22) Filed: Jul. 27, 1999

Related U.S. Application Data

(60) Provisional application No. 60/094,200, filed on Jul. 27, 1998.

(51) Int. Cl.[7] ..... B41L 1/24

(52) U.S. Cl. ..... 462/25; 462/22; 462/24; 462/28; 462/39; 283/116

(58) Field of Search ..... 283/116; 462/22, 462/24, 25, 28, 39

(56) References Cited

U.S. PATENT DOCUMENTS

| | | | | |
|---|---|---|---|---|
| 4,824,142 | * | 4/1989 | Dossche | 283/116 |
| 5,154,668 | * | 10/1992 | Schubert | 283/116 |
| 5,224,897 | * | 10/1992 | Linden et al. | 462/24 |
| 5,294,041 | * | 3/1994 | Whiteside | 283/116 |
| 5,314,208 | * | 5/1994 | Strickland | 283/116 |
| 5,393,265 | * | 2/1995 | Linden et al. | 283/116 |
| 5,395,288 | * | 3/1995 | Linden et al. | 462/18 |
| 5,413,383 | * | 5/1995 | Laurash et al. | 283/116 |
| 5,435,600 | * | 7/1995 | Griffiths et al. | 283/116 |
| 5,836,622 | * | 11/1998 | Fabel | 283/116 |
| 5,913,725 | * | 6/1999 | Goldring | 283/116 |

FOREIGN PATENT DOCUMENTS

| | | | | |
|---|---|---|---|---|
| 2180501 | * | 10/1961 | (GB) | 283/116 |
| 570601 | * | 10/1961 | (BE) | 283/116 |
| 3818-120 | * | 12/1988 | (GB) | 283/116 |

* cited by examiner

*Primary Examiner*—Henry Tsai
*Assistant Examiner*—Alisa L Thurston

(57) ABSTRACT

This particular combination of steps in the overall process; the spot coating on a single side of a page, as well as on both sides of the page, in a specific pattern are new and unique. The ability to print multiple orientations on a single side of a page or in duplex fashion is not technology, but is an integral part of the overall process. The folding both horizontally and vertically for the 4-part form, or the "Z" fold for the 3-part form, is not new technology, but is an integral part of the overall process in creating this finished product. The combination of the specific patterns and locations of the spot coatings, the printing in certain areas of the page with certain orientations, and the specific manner in which each single page is folded to become a 3 or 4-part form is unique and patentable. This unique product opens up a whole new product market for the "quick print" or "print-on-demand" industry, and gives the customer more choice, faster turn-around, and at a lower cost for small volumes.

15 Claims, 8 Drawing Sheets

SINGLE PAGE MULTI-PART FORM OR "QUIKFOLDFORM"

This application claim benefit to provisional application Ser. No. 60/094,200 filed Jul. 27, 1998.

This "Utility Patent Application" centers around an invention that consists of a single piece of paper that is designed, produced, and printed in such a manner that it can be folded and perform the same function as a multiple part form. This invention is particularly adapted for use as a 3 or 4-part form such as a 3-part receipt or a 4-part "bill of lading" currently utilized by numerous companies. The design is such that a blank piece of paper pre-perfed and coated in the proper areas with the microencapsulation Coated Front (CF) and Coated Back (CB) formulas for "No Carbon Required" (NCR) or carbonless forms; printed with the proper font rotation in the correct areas of the paper and then folded properly will function in the same manner as a 3 or 4-page multi-part form. In other words, after the finished page is printed and folded, then written on from the top, all the information from the top is also printed on each additional page of the folded form and is aligned in the proper blank or field identical to the front page.

The process and components for creating the finished product consists of cut sheet paper that can be (but not required) in standard sizes such as 8½"×11" for the 3-part, or 11"×17" for the 4-part. The paper would be manufactured in such a manner that certain specified areas of the page on both sides are spot coated with the specific formulas of "Coating Front" (CF) or "Coating Back" (CB) No Carbon Required (NCR) solutions. (This product is designed to utilize Mead OPAS's spot coating technology and coatings.) See FIG. 1 for Side A or the front of the 4-part product, and FIG. 2 or Side B of the 4-part, to see the proper location and size of the CF and CB spot coated areas. FIGS. 4 and 5 show the proper locations and size for the CF and CB coatings for the 3-part form. These pages are also perfed at specified locations (both vertically and horizontally for the 4-part and just horizontally for the 3-part), to facilitate easy folding, and proper alignment of the printed data in each section, as part of the manufacturing process. These perfs will also be used to allow the finished product to match at all edges if desired. The perfing can be done before, after or at the same time the CF and CB coatings are applied, or even as part of the printing process. This specially manufactured paper has spot coatings in a specific pattern on the front and back, with the printed areas that make up the form, having specific rotations to allow the paper to be folded and then utilized in the same manner as a multi-part form. This specific duplex printing process with multiple font rotations could be done on a press, duplex copier, or with a duplex laser printer, and is done so all printing has the same orientation after the proper folding sequence on both forms. The finished printed page could either be folded manually or through existing finishing devices that fold in the desired manner. The process could also include the trimming of two sides of both forms, and spot glue one edge to produce a finished 3 or 4-part form that is aligned and glued as a finished product.

CROSS REFERENCED OR RELATED PATENTS

This specification acknowledges previous patents related to microencapsulation formulas (as the Mead OPAS coatings this invention is designed to utilize) and methods of applying the coatings, as well as standard NCR forms, held by companies such as Mead Corporation, RT Dodge, Moore Business Forms, and others. This application is unique in that the finished product is spot coated with both CF and CB on the same side of the paper, as well as on both sides of the single sheet of paper used to make the multi-part forms. CF and CB coatings are spot applied and printed on only one piece of paper, in such a manner as to facilitate a specific application and use, rather than multiple pieces of paper being manufactured separately and then glued together with the NCR coatings applied or carbon paper inserted to form the finished multi-part form product. The CF and CB coatings themselves, in this application, are just parts of the overall process, even though the specific layout of the areas coated is unique. Our process utilizing these coatings along with the claims made in this application, should not (to our knowledge) nor is it intended to, infringe on any current patents since we are in no way modifying the current products or processes already patented. The only patent we found even remotely related is European patent #EP0891260, but this form is only a two-part form developed for only one specific medical application. It does not utilize spot coatings but on one side of a page and is folded to form a 2 part form only.

Advantages to this invention are several. This design and the production process will result in tremendous cost savings in the ability to provide the same functional "bill of lading" with only one piece of paper, rather than 3 or 4 separate sheets, glued together with either carbon sheets or NCR coating technology. Most of the shipping companies utilize internally and provide to their customers, these forms in a continuous forms style, that are either tom apart and written by hand, or printed on a continuous forms printer such as a dot matrix. The continuous form version is even more expensive to produce than the individual or separate style "bill of lading" form. Through existing printing technology from either a laser printer or duplex press, a blank piece of CF and CB spot coated can be printed on both sides utilizing duplex printing technology with some inverted fonts and forms that result in the same multi-part form layout as the current multi-part forms in use today, after proper folding. The difference is the finished products will not only cost significantly less than the traditional 3 or 4-part forms, but can be produced much faster.

This invention is targeted to shipping or other companies who utilize 4-part "Bills of Lading" or "Airbills" that can be written or typed on and all 4-parts receive and display the same information either through carbon sheets between the top three parts, or NCR microencapsulation coating technology currently in use today in 2,3,4,5,etc- part preprinted forms. The design of this "One Page Multi-Part Form" will allow an individual or folding machine to make 2 folds of the page and have a ready to use 3 or apart form, with the same inherent advantages of the traditional 3 or 4-part form.

BACKGROUND OF THE INVENTION

The current multi-part forms manufacturing process, requires numerous steps in the production process, resulting in a much more costly form in both components, as well as manpower, machinery and electrical power. The current design requires separate pages of paper, preprinting expense, cutting of the paper into appropriate sized sheets, production of carbon paper sheets made with "no carbon spots" (if utilized), inserted between the appropriate pages, and cut to the proper size (or CF & CB, NCR coated pages), alignment and assembly of all components, gluing of the edges, punching of tractor pin holes in the edges or outside borders of the continuous forms and perfing between forms. Not only does this design use more components, more labor, require more expensive and specialized machinery to manufacture, more consumption of electrical power—but is much heavier as a finished product. This single page design will also allow for "print on demand" production of personalized or sequentially numbered forms. Sequentially numbered or personalized forms currently require an additional step or pass in the printing process, or an expensive digital press, to produce these forms for companies that don't want to have to manually fill out their company's information in the shipping portion of the form. Specific offices where the shipping information is always the same for that particular location usually use these. The existing process and design is normally preprinted and then the personalized company address information or sequentially numbering or personalized account numbers printed on the form after the form has already been produced as a standard blank as part of a mass production run. This personalization process adds even more expense to the product and overall process. Most multi-part forms are ordered in huge quantities to provide for the lowest cost per form, and may have to be trashed or marked up if information such as phone number, address, account numbers, etc, change after the printing.

It is therefore the object of this invention to provide an equally functional multi-part form, but without the expense and waste of the current process and product in use today. Utilization of this invention will also result in less consumption of natural resources, electrical power, less fuel for transporting since it will weigh less, while also reducing storage space since it can be printed on demand. The ability to produce this product on demand via duplex laser technology allows for production to be done in many in-house print shops, or local "quik copy" or "print-on-demand" facilities, such as Kinkos or other "quick print" franchises.

BRIEF SUMMARY OF THE INVENTION

This invention consists of a single piece of paper that is spot coated with CF and CB coatings, perfed at specific locations and orientations, duplex printed with specific areas utilizing 180° rotated fonts, and folded in a precise manner so it can be used as a multiple part form. All these steps of the process have to be done in a specified manner for both the 3 and 4-part forms to be functional after the process is completed. The process and product are manufactured utilizing the same unique idea, but with specific differences for each multi-part form. After this product is produced as blank perfed and coated paper stock for each 3 or 4-part form, it can be printed and folded in one pass to provide a ready-to-use multi-part 3 or 4-part form. Current processes and technology for production of multi-part forms are multi step processes that also require specialized equipment. Multi-part forms are normally done in large order volumes to get a low cost per form due to the high setup charge associated with the specialized equipment currently used. This product will allow the same functional product to be produced on standard, cut sheet, non-impact duplex laser printers, cut sheet duplex presses, or standard duplex copiers—on demand with limited setup and very quickly run the entire order. This invention will provide all quick print shops, in-house print shops, and copy shops that have this standard printing and copying equipment, the ability to produce these multi-part forms, with minimum setup, in a shorter timeframe than ever before, and at a much lower cost for the same volume of production. Currently this product is not an option to this group of printers due to the lack of this product and process.

BRIEF DESCRIPTION OF THE DRAWINGS

The 5 drawings on the accompanying pages provide for the proper layout of the CF and CB coatings on front and back and the required printing font rotation to create the form areas, along with the proper step by step folding instructions to have a functional 3 or 4-part form from one piece of paper. FIGS. 7 & 8 show the combination of coating and font orientation for the 3 and 4 single sheet multi-part forms.

DETAILED DESCRIPTION OF THE INVENTION

This invention is for a apart or 4-part form to be produced from one sheet of paper, spot coated on both sides of the paper with special CF and CB coatings, printed in a specific duplex manner, and then folded in a specific fashion.

The 3-part form is as follows:

A single sheet of 16 to 24 pound standard cut sheet paper that can be a standard size such as 8½"×11 (or any desired size that is appropriate) is spot coated with Coated Front (CF) and Coated Back (CB) coatings, such as MEAD OPAS coatings, in specific areas on the same side of the page, and also on the opposite side of the page so CF and CB coatings are touching after folding.

This spot coating technique is standard procedure for MEAD OPAS coating equipment, and this type of equipment would be used to produce the blank coated stock described in the process for production of both the 3 and 4-part blank stock. We make no claims about the coating products or existing coating process, just the layout, sequence or topographical manner in which the coatings are spot applied in duplex fashion to the single sheet of paper described in this application. The spot-coated areas with both CF and CB are used on the same side of the paper, as well as on both sides of the page, in a specific layout.

Figure 4:
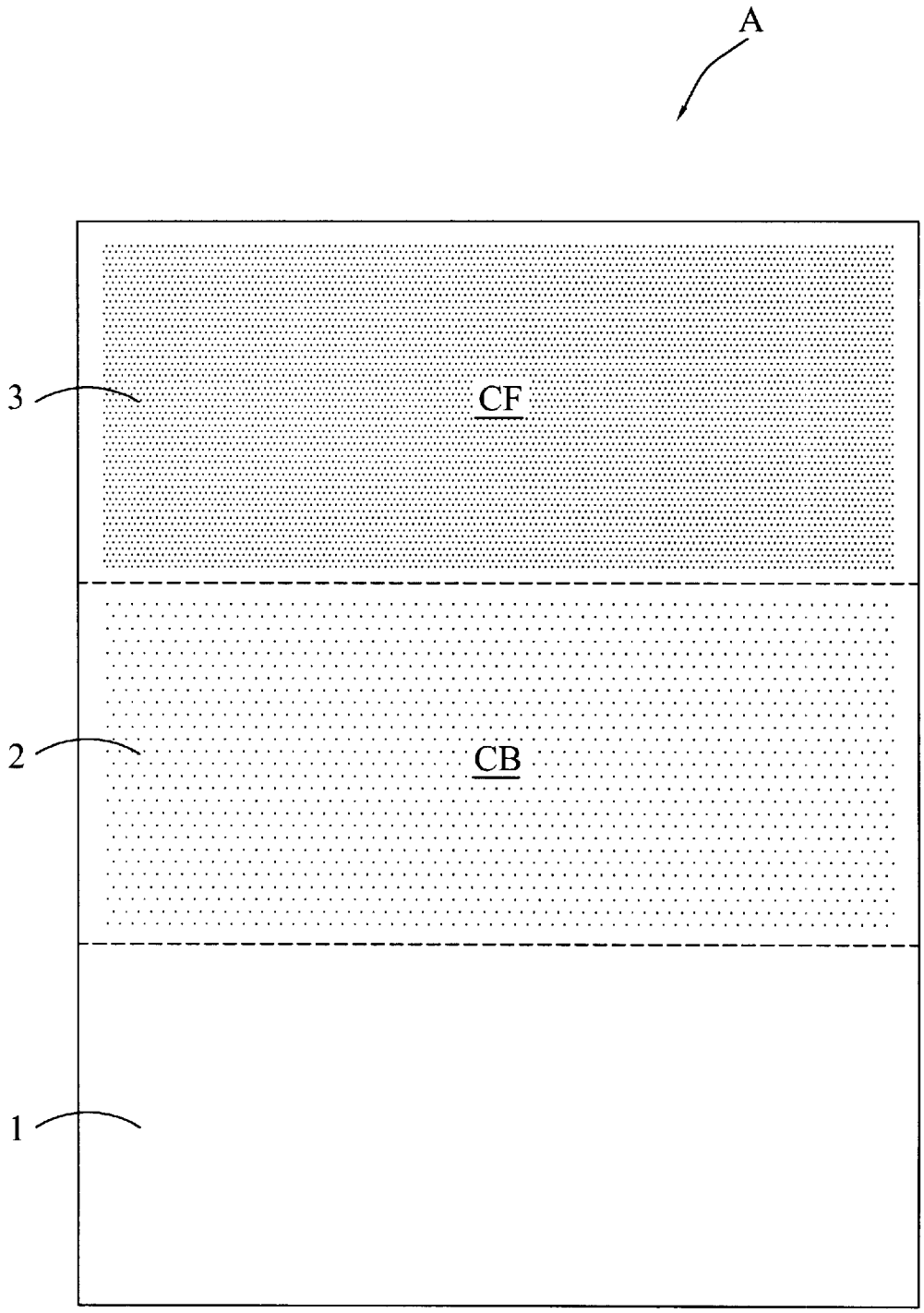
FIG. 4—Shows the Front Side A of the page to be used as a 3-part form, with the proper page layout orientation, the proper print font and form orientations, and the proper spot locations of the CF and CB coatings, along with the perf orientation and locations.

For Side A, or the front as shown in FIG. 4, the top third or Section 3 of the page is spot coated with CF coating. The middle third of the page or Section 2 of the page as noted on FIG. 4, is spot coated with CB coating. Section 1 of the page, or the bottom third has no coating applied.

Figure 8B:
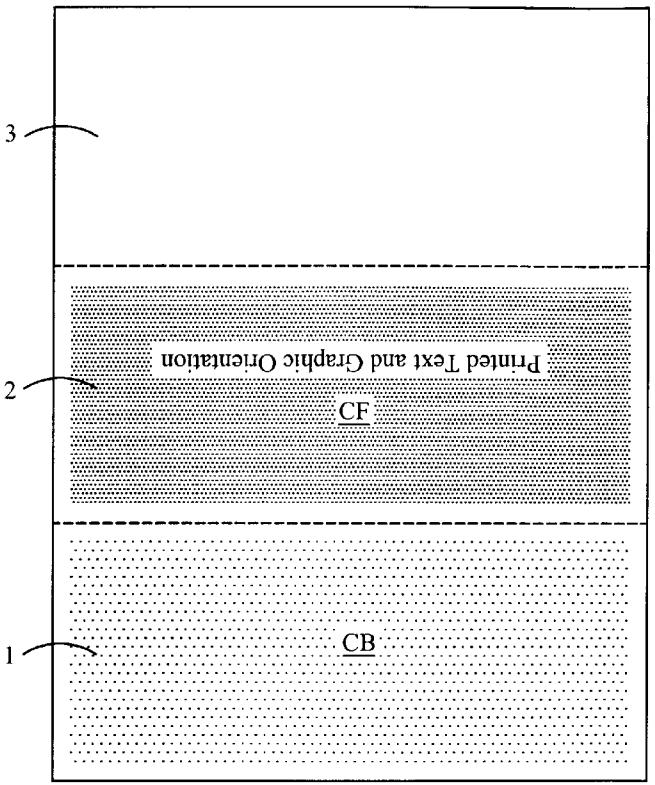
FIGS. 8A and 8B—Show the 3-part form page with the correct location of the CF and CB coatings layout, along with the proper print orientation for all 3 sections on both Side A and Side B as shown in FIGS. 4 & 5.
Figure 8A:
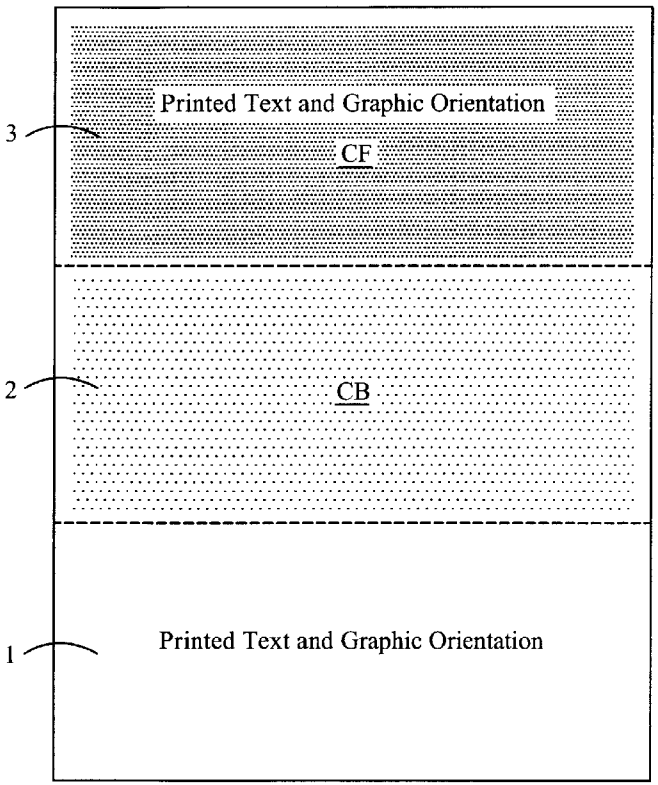

With the page turned over so the top edge of Side A is the top edge of Side B, the back of the page or Side B, would not be coated in Section 3, or the top third of the page. The middle third of the page, or section 2 would be spot coated with CF coating, and the bottom third, Section 1, would be spot coated with CB coating. FIG. 8 shows the spot coatings layout along with the proper font orientation of the printed text and graphics that make up the printed information of the form.

The paper would be perfed horizontally between Sections 1 & 2, and also between Sections 2 & 3 across the entire page.

Figure 5:
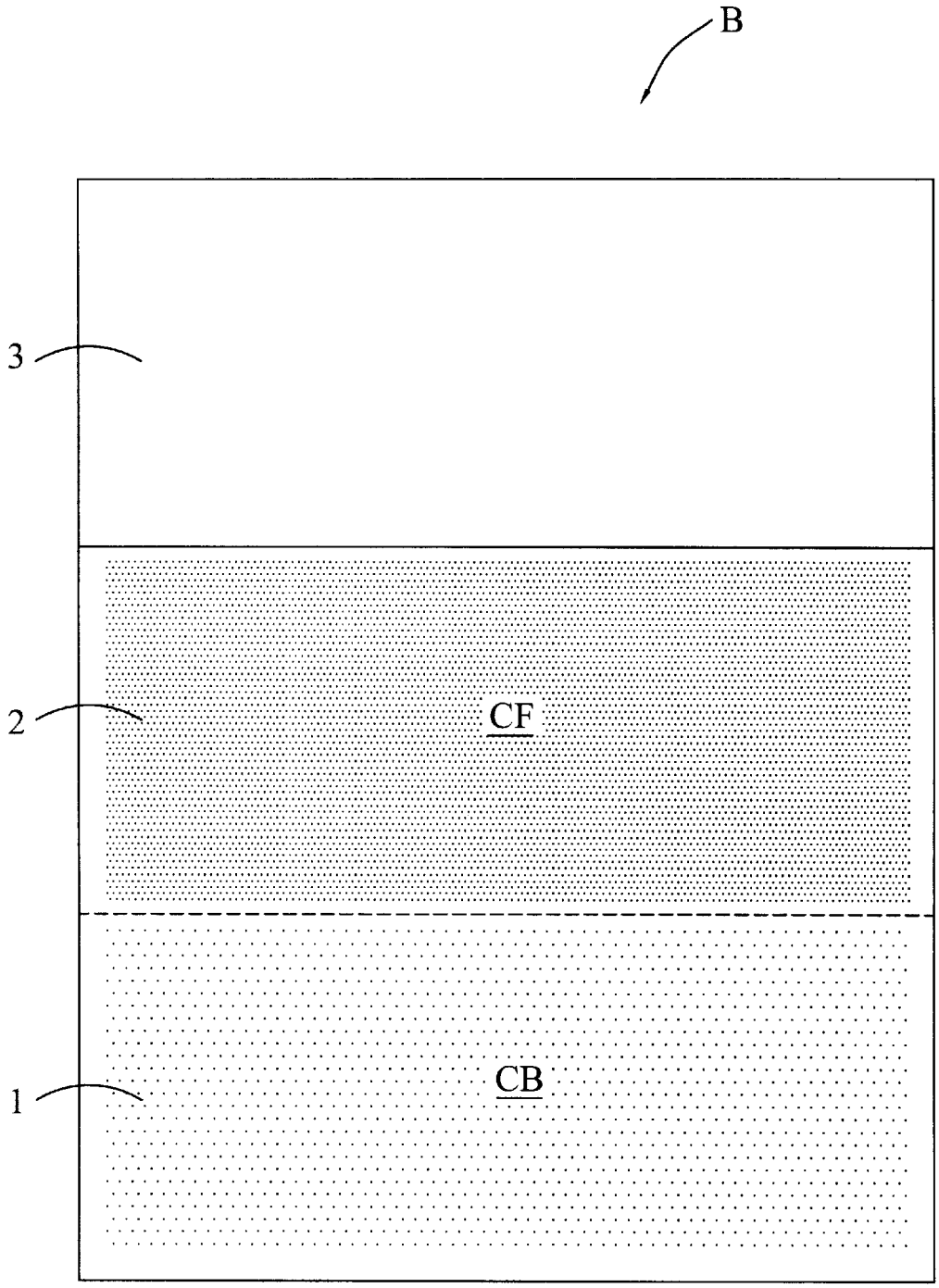
FIG. 5—Shows the Back Side B of the same page used as a 3-part form, opposite of Side A, with the proper page orientation, the proper print font and form orientations, and the proper spot locations of the CF and CB coatings, along with the perf orientation and locations.

This blank stock would then be printed in such a manner with non-impact duplex laser printers, duplex presses, or duplex copiers as follows;

With Side A oriented face up the top edge as shown in FIG. 4, the static form text and graphics will be printed or copied in standard font orientation in Sections 1 & 3 to make the front sides of parts 1 and 3 of the form. In the process of duplex printing, the middle section of Side B as show in FIG. 5, would have the same static form text and graphic information printed or copied, as the front Side A, Sections 1 & 3, but printed with 180° rotation, (or upside down) to the print orientation of Side A. This upside down text and graphic rotation allows the printed contents of all 3-parts of the form, or pages, to be aligned with the same orientation after folding.

Figure 6:
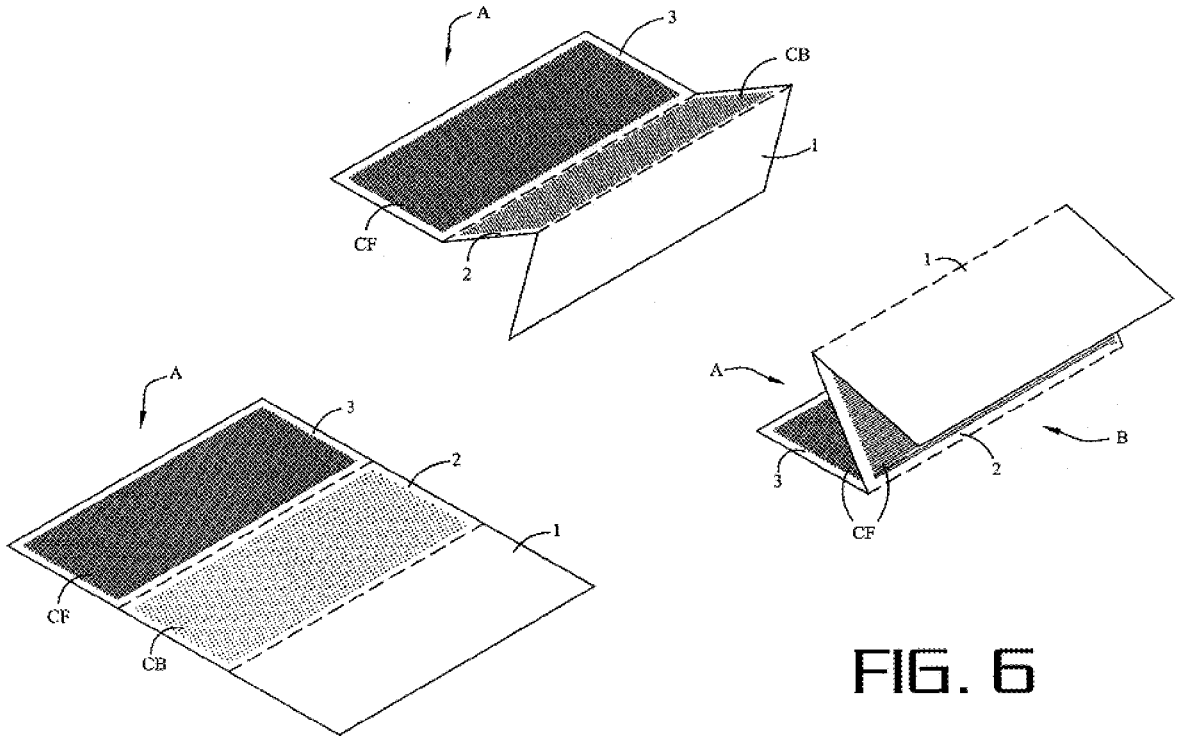
FIG. 6—Shows the proper page orientation before folding and the folding sequence to result in a properly functioning 3-part form from a single sheet of paper.
Figure 7A:
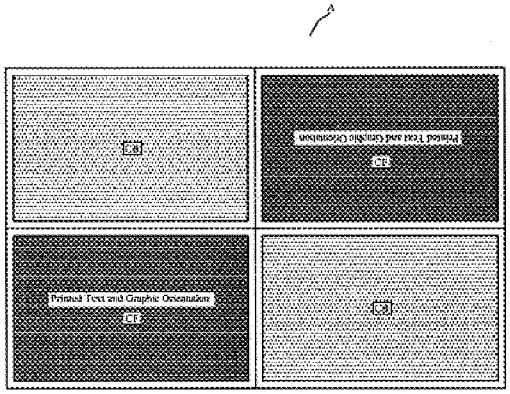
FIGS. 7A and 7B—Show the 4-part form page with the correct location of the CF and CB coatings layout, along with the proper print orientation for all 4 quadrants on both Side A and Side B as shown in FIGS. 1 & 2.
Figure 7B:
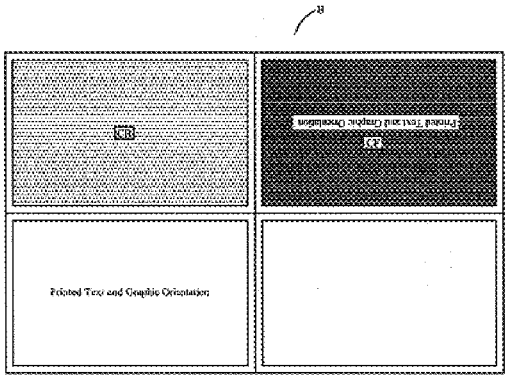

With Side A of the paper facing up, and the top edge oriented as shown in FIG. 4, the paper is then folded on the perfs with Section 1 folded back under Section 2 and then both Sections 1 & 2 are folded over on top of Section 3 as shown in FIG. 6. This is commonly called a standard "Z" fold in the printing industry, and is a standard fold on all automated folding equipment. Folding can be accomplished manually or via an automated folder.

After folding, the finished form could be left as is and when written on the top page, all the written information will be transferred to the $2^{nd}$ and $3^{rd}$ pages by the chemical reaction of the CF and CB mixing. The written information will fall in the same fields of the $2^{nd}$ and $3^{rd}$ pages of the form due to the proper alignment of the form information and folding sequence. The finished form could then be easily torn apart at the perfs. Should a more finished form be desired, the perfed edges could be trimmed, and one end of the 3 sections spot glued together to hold the form intact.

For the 4-part form, the process is as follows:

A single sheet of 16 to 24 pound standard cut sheet paper, that can be standard size such as 11"×17", (or any size desired) is spot coated with Coated Front (CF) and Coated Back (CB) coatings, such as MEAD OPAS coatings, in specific areas on the same side of the page, but on the opposite side, or back, of the paper as well, so all the CF and CB coatings are touching after the paper is folded.

Figure 1:
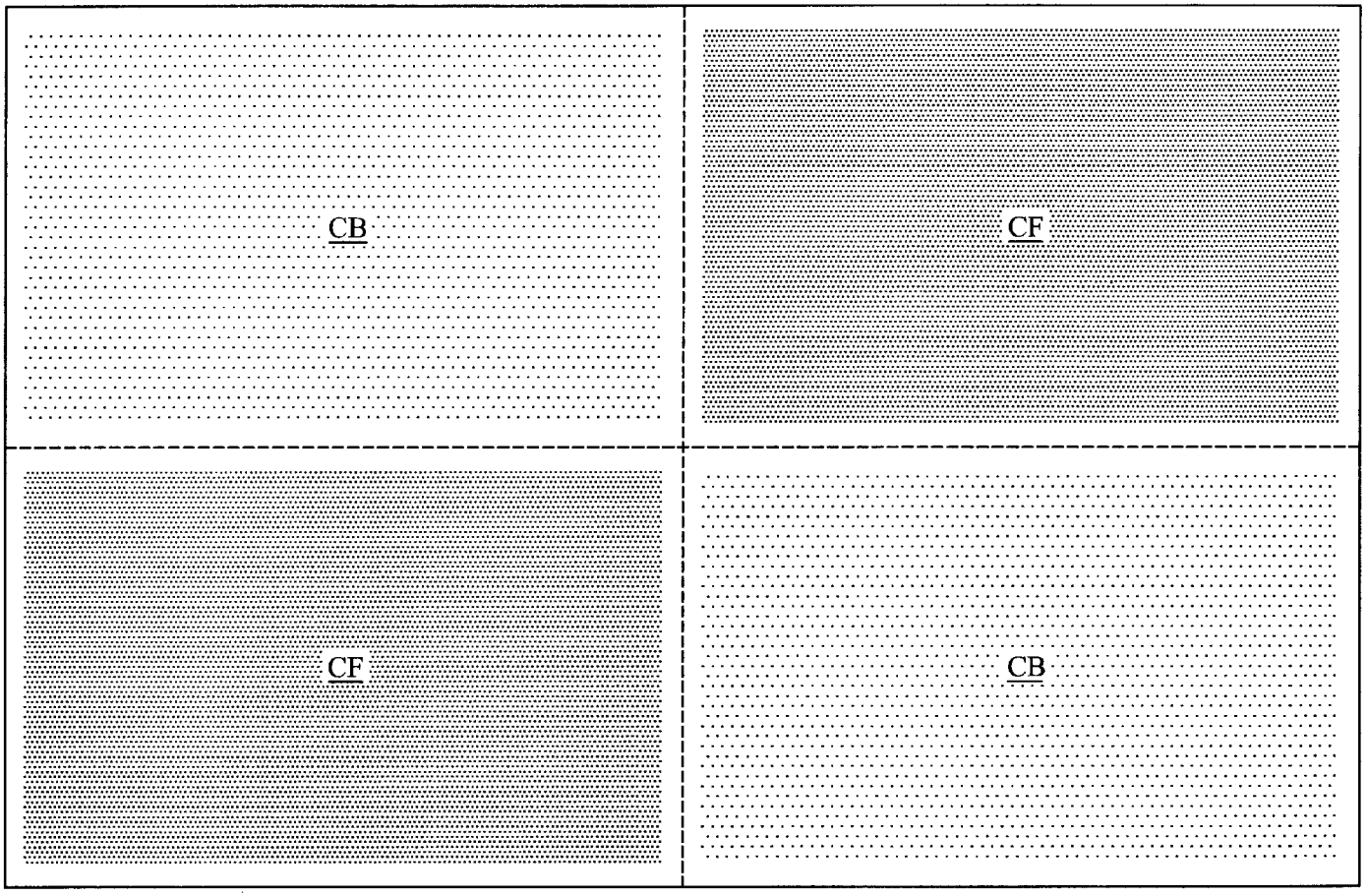
FIG. 1—Shows Side A with the top edge orientation and type and locations of the CF and CB Spot coatings, and the location of the perfs, for the single page to be used as a 4-part form layout.
Figure 2:
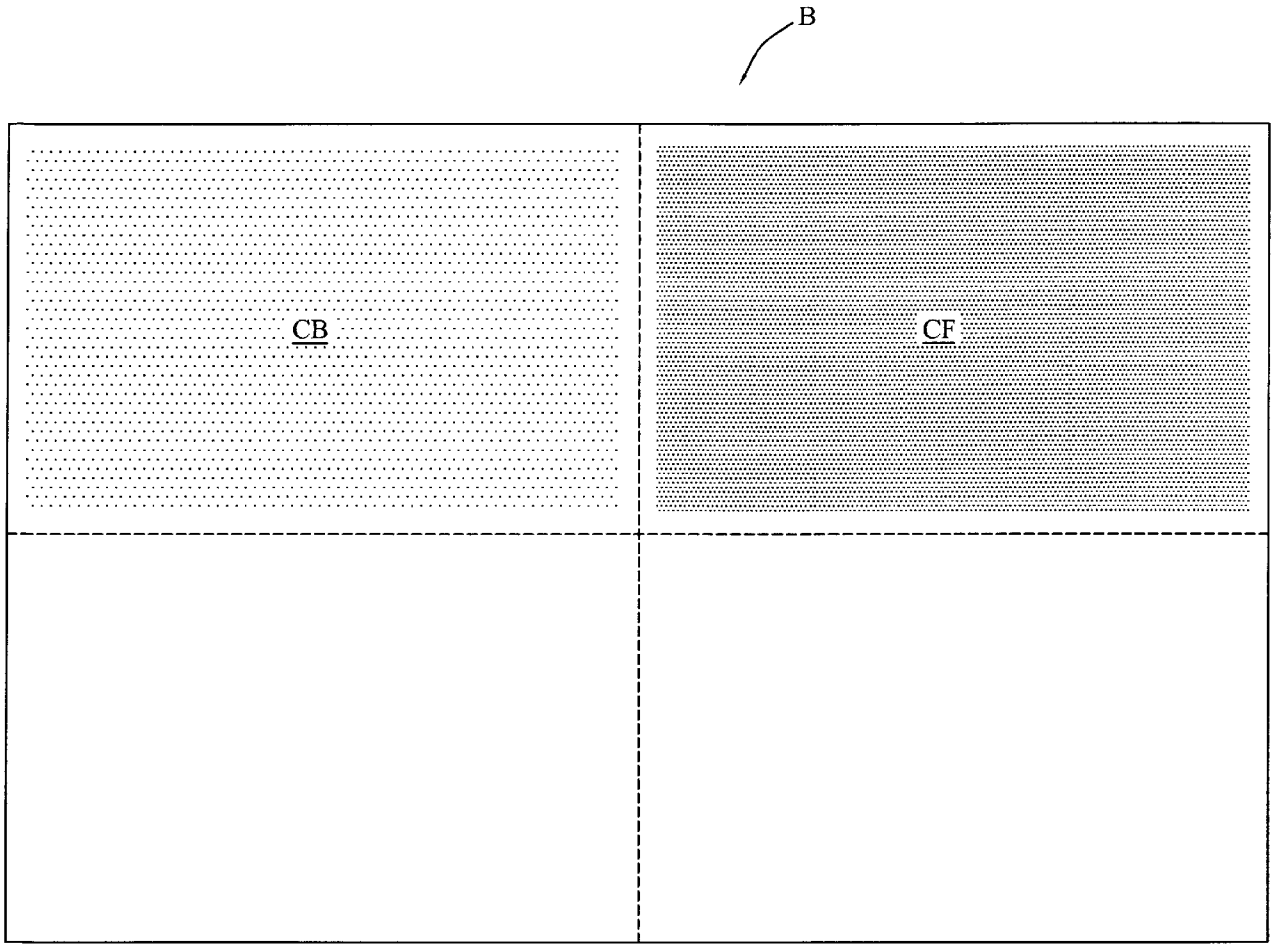
FIG. 2—Shows Side B (or the back side of the same page as Side A) as if you took Side A and turned it over from left to right so the top of Side A page is the same as the top of Side B page. This drawing shows the same location of the perfs, and the specific orientation for the CF and CB spot coating applications for Side B.
Figure 3:
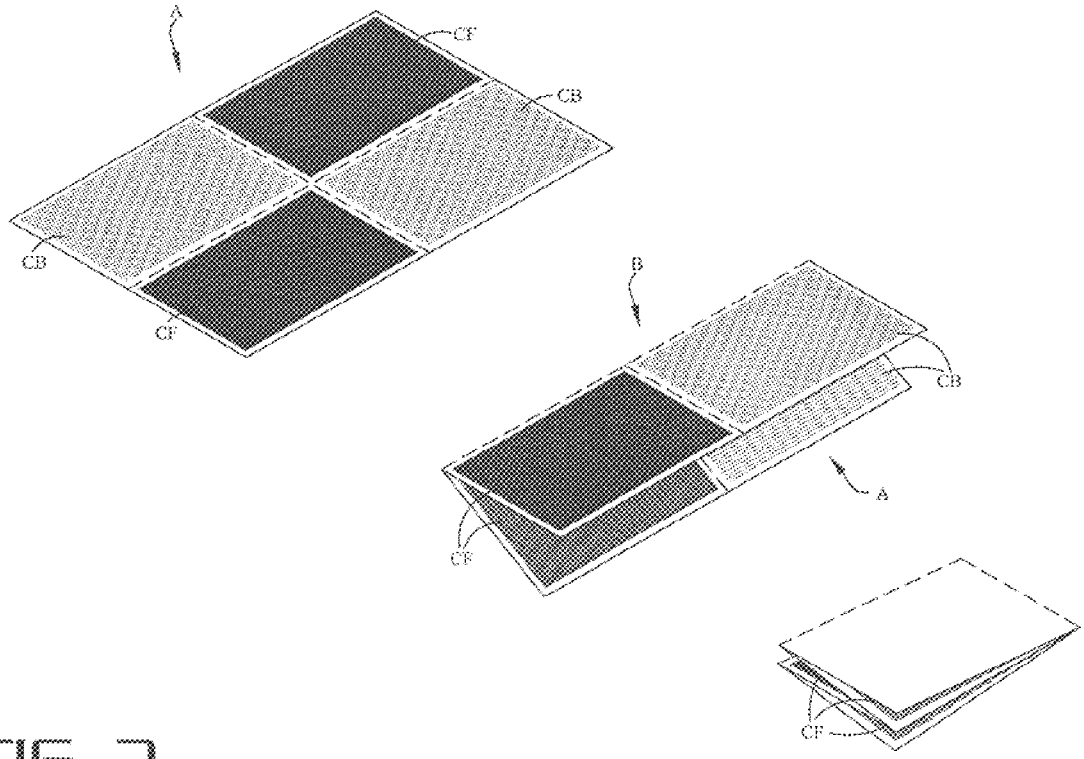
FIG. 3—Shows the proper folding procedure with Side A of the page facing up and laying in landscape orientation. Step 1 consists of orienting the page to be in the specified manner after being printed with the static form text and graphic information on both sides. The top half of page Side A is folded down on top of the bottom half of Side A, along the horizontal perf. The page is then folded by taking the right half of the remaining half folded page and folding it on the perf, to be on top of the left half folded remaining portion of the page. The result is a matching size and print oriented multi-part form that allows you to write on the top and have the same information passed through to all other remaining pages.

For Side A, or the front side, with the top edge of the page oriented as shown in FIG. 1, the page would be divided up into 4 equal quadrants, with 2 top and 2 bottom quadrants. The top left quadrant and bottom right quadrant will be spot coated with CB coatings. The top right and bottom left quadrant will be coated with CF coating. The page will be perfed both horizontally and vertically to align with the quadrant borders that run through the middle of the page as shown on FIG. 1.

For Side B, or the back side, with the top edge oriented the same as Side A, the top left quadrant is spot coated in CB coating, and the top right quadrant is spot coated in CF coating. The bottom left and right quadrants are not coated.

The blank paper stock is then ready for printing on a standard non-impact duplex laser printer, duplex copier, or duplex press with the static text and graphic information that will make up the form on the paper. The printing will be done in one pass with the orientation on Side A as follows for each quadrant: The top left and top right quadrants are both printed with different information, since the top left quadrant will be the back of form page #3, and the top right quadrant will be the front of form page #2. These two top quadrants will be printed with 180° text and graphic rotation (or upside down) to the original orientation of the top edge of the page. The bottom left and right quadrants would be printed in normal text and graphic orientation compared to the top edge of Side A. The printed information in the bottom left quadrant would be the front page of form page #4, and the bottom right quadrant would be the back of form page #1.

Through the duplex step in the printing process, the same top edge of Side B (or the back of Side A) would match in orientation as if you took the page with Side A facing up and turned over from the left to the right. With Side B blank of printed information, the quadrants would be printed as follows: The top left and right quadrants would be printed with different information since the top left quadrant will be the back of form page #2, and the top right quadrant will be the front of form page #3. These two top quadrants will be printed with 180° text and graphic rotation (or upside down) to the original orientation of the top edge of the page. The bottom left and right quadrants would be printed in normal text and graphic orientation compared to the top edge of Side B. The printed information in the bottom left quadrant would be the front page of form page #1, and the bottom right quadrant would be the back of form page #4. See FIG. 8 for the proper locations of the spot coatings on both Side A and B and the proper form print orientation for each quadrant on both Side A and B.

What is claimed is:

1. A quick fold form for making multi-part copies comprising:

a) a rectangular sheet of paper having a front side and a back side;

b) a horizontal line of perforation separating said sheet into a rectangular upper portion and a rectangular lower portion, said horizontal line being centrally positioned on said sheet with said upper potion and said lower portion having substantially equal dimensions;

c) a vertical line of perforation separating said sheet into a rectangular left portion and a rectangular right portion, said vertical line being centrally positioned on said sheet with said left portion and said right portion having substantially equal dimensions, said horizontal line intersecting said vertical line at a right angle and separating said sheet into quadrants having substantially equal dimensions;

d) a CF coating applied to said front side covering substantially entirely two of said quadrants, said two quadrants being diagonally aligned;

e) a CB coating applied to said front side covering substantially entirely the remaining two of said quadrants;

f) a CF coating applied to said back side opposite said CB coating covering substantially entirely one quadrant in said upper portion;

g) a CB coating applied to said back side opposite said CF coating covering substantially entirely the remaining quadrant in said upper portion;

such that said upper portion is foldable to overlie said bottom portion with the CF and CB coating on said quadrants on said front side abutting and such that said form is foldable with said CF coating and CB coating on said back side abutting.

2. A quick fold form as described in claim 1 wherein the size of said sheet of paper is 8.5 inches by 11 inches.

3. A quick fold form as described in claim 1 wherein the size of said sheet of paper is 11 inches by 14 inches.

4. A quick fold form as described in claim 1 wherein the size of said sheet of paper is 11 inches by 17 inches.

5. A sheet for forming a four-part carbonless copy form comprising:

a) a rectangular sheet of paper having an upper face, a lower face, a horizontal line centrally located on said sheet, a vertical center line centrally located on said sheet perpendicular to and intersecting said horizontal line such that said lines divide said sheet into four rectangle quadrants of equal dimensions, including an upper left quadrant, an upper right quadrant abutting said upper left quadrant, a bottom left quadrant abutting said upper left quadrant, and a bottom right quadrant abutting said upper right quadrant and said lower left quadrant;

b) a CF coating applied to said upper face covering said lower left quadrant and said upper right quadrant, and applied to said lower face covering said upper left quadrant; and c) a CB coating applied said upper face covering said upper left quadrant and said lower right quadrant, and applied to said lower face covering said upper right quadrant such that said sheet may be folded about said horizontal line and said vertical line to form abutting surfaces alternately coated in CF and CB coating.

6. A sheet for forming a four-part carbonless copy form as described in claim 5 further comprising perforation along said horizontal centerline and said vertical centerline.

7. A sheet for forming a four-part carbonless copy form as described in claim 5 or 6 wherein the size of said sheet of paper is 8.5 inches by 11 inches.

8. A sheet for forming a four-part carbonless copy form as described in claim 5 or 6 wherein the size of said sheet of paper is 11 inches by 14 inches.

9. A sheet for forming a four-part carbonless copy form as described in claim 5 or 6 wherein the size of said sheet of paper is 11 inches by 17 inches.

10. A method for making a quick fold four-part carbonless copy form comprising the steps of:

a) applying no carbon required coatings to a rectangular sheet of paper having a front side, a back side, a horizontal line, a vertical line perpendicular to and intersecting said horizontal line such with said lines separating said sheet into rectangular quadrants having substantially equal dimensions including an upper left quadrant, an upper right quadrant abutting said upper left quadrant, a bottom left quadrant abutting said upper left quadrant, and a bottom right quadrant abutting said upper right quadrant and said lower left quadrant, such that no carbon required CF coating is applied to the front side of said bottom left quadrant and said upper right quadrant, and to the back side of said upper left quadrant, and no carbon required CB coating is applied to the front side of said upper left quadrant and said lower right quadrant, and the back side of said upper right quadrant;

b) folding said sheet a first time along said horizontal line to form abutting surfaces on said front side alternately coated in CF and CB coating; and c) folding said sheet a second time along said vertical line to form abutting surfaces on said back side alternately coated in CF and CB coating.

11. A method for making a quick fold four-part carbonless copy form as described in claim 10 further comprising perforating said sheet along said horizontal line and said vertical line to allow the sheet to be folded easily prior to said first folding step.

12. A method for making a quick fold four-part carbonless copy form as described in claim 10 further comprising printing pre-coating information on said sheet prior to said application step.

13. A method for making a quick fold four-part carbonless copy form as described in claim 11 or 12 further comprising printing post-coating information on said sheet after said application step and prior to said first folding step.

14. A method for making a quick fold four-part carbonless copy form as described in claim 13 further comprising adding a means for attaching said quadrants.

15. A method for making a quick fold four-part carbonless copy form as in claim 14 further comprising trimming one or more edges of said quadrants after said second folding step.

* * * * *